US006610082B2

(12) United States Patent
Park

(10) Patent No.: US 6,610,082 B2
(45) Date of Patent: Aug. 26, 2003

(54) ELECTRIC FAN WITH FAR INFRARED RAY LAMP

(76) Inventor: Chan Seok Park, 345-10, Woo 1-dong, Haewoondae-gun, Busan 612-819 (KR)

( * ) Notice: Subject to any disclaimer, the term of this patent is extended or adjusted under 35 U.S.C. 154(b) by 12 days.

(21) Appl. No.: 10/033,348

(22) Filed: Dec. 28, 2001

(65) Prior Publication Data

US 2003/0050679 A1 Mar. 13, 2003

(30) Foreign Application Priority Data

Sep. 12, 2001 (KR) ..... 2001-56310
Nov. 27, 2001 (KR) ..... 2001-74252

(51) Int. Cl.[7] ..... A61F 7/12; A61F 2/00

(52) U.S. Cl. ..... 607/96; 607/100; 392/365; 392/376

(58) Field of Search ..... 607/88, 96, 98, 607/100, 108–111; 392/365–367, 375–377, 384–385, 407, 410; 34/96–97, 266–267

(56) References Cited

U.S. PATENT DOCUMENTS

| | | | | | |
|---|---|---|---|---|---|
| 1,006,767 | A | * | 10/1911 | Mauger | 392/410 |
| 1,674,017 | A | * | 6/1928 | Marsden | 392/376 |
| 1,961,772 | A | * | 6/1934 | Martin | 392/383 |
| 4,263,500 | A | * | 4/1981 | Springer et al. | 392/410 |
| 6,205,677 | B1 | * | 3/2001 | Yune | 34/266 |
| 6,381,407 | B2 | * | 4/2002 | Choi | 392/376 |

* cited by examiner

*Primary Examiner*—Roy D. Gibson
(74) *Attorney, Agent, or Firm*—Darby & Darby

(57) ABSTRACT

Disclosed is an electric fan including a driving motor, a blower fan unit, and front and rear safety nets. A far infrared ray lamp part including a socket and a far infrared ray lamp is positioned in front of the blower fan unit. The front and rear safety nets are detachably fastened to each other by a fastening ring. A lamp protective net, which is covered with a stainless coating to be decreased in heat conductivity and heat-resistant, is placed in front of the far infrared ray lamp part where heat is generated.

5 Claims, 5 Drawing Sheets

ELECTRIC FAN WITH FAR INFRARED RAY LAMP

BACKGROUND OF THE INVENTION

1. Field of the Invention

The present invention relates to an electric fan with a far infrared ray lamp serving as a hyperthermic therapy appliance. More particularly, the present invention relates to an electric fan with a far infrared ray lamp serving as a hyperthermic therapy appliance, wherein hyperthermic heat discharged from the far infrared ray lamp and blown air of the electric fan can be independently or simultaneously used, to ensure that a wound heals, a pain is relieved, and muscle aching due to stress, etc. is eased and restores its functionality in a short period of time, while the body and hair are dried in the current of the electric fan, for example, after taking a shower or a bath.

2. Description of the Related Art

Generally, it has been known in the art that, while some kinds of electromagnetic waves are beneficial to the human body upon being appropriately used, most kinds of electromagnetic waves are harmful to the human body.

Specifically, since X-rays are very dangerous to the human body, exposure to X-rays must be minimized as much as possible when they are utilized for medical diagnosis. Also, if the human body is overly exposed to ultraviolet rays, skin cancer may be caused. Further, excessive exposure to electromagnetic waves produced from a radiotelephone or a TV may induce various side effects such as a swollen face and pain.

In contrast, electromagnetic far infrared rays are not only harmless to humans, but they also promote metabolism by promoting blood circulation in capillaries. Therefore, exposure to far infrared rays is desirable.

A steam bath, which was created in prehistoric times and uses a principle that far infrared rays are produced when heat of burning firewood passes through mud, can be regarded as an early sauna using far infrared rays. In addition to this, far infrared rays are widely used in medical treatment instruments, a thermometer, sensors, radio communication equipment, an exploration system, etc.

In particular, since far infrared rays can penetrate into the skin by about 40 mm, a resonance and vibration absorbing phenomenon occurs in the skin, molecular motions are facilitated in cells of the human body, and blood circulation is promoted through expansion of capillaries, whereby the human body generates heat.

Stress built up by continued tensity of an autonomic nerve system is regarded as a main cause of modern diseases. In this regard, far infrared rays raise a temperature of a hypodermic layer, expand capillaries, promote metabolism, activate cellular tissues, facilitate excretion, and relieve fatigue.

Far infrared rays beneficial to the human body as described above are not popularized in such a way as to be conveniently used in daily life, and a typical way to use far infrared rays is limited only by the physical therapy appliance employed in a hospital or an auxiliary device for a kneader. Therefore, it is difficult for individuals to experience efficacy of far infrared rays. In this connection, upon using a far infrared ray sauna for individuals, a location-related limitation cannot but be imposed on users, and expenses are incurred.

In the meanwhile, while the conventional electric fan is categorized as a seasonal product and used only in summer, air blown by the conventional electric fan may cause annoyance in winter.

Although the body is usually dried with a towel or electric fan after taking a shower, this may be inconvenient since a substantial period of time is required to completely dry the body. Also, although the hair is usually dried employing a hair drier, hair may be damaged due to the use of the hair drier.

Further, when it is necessary to foment a portion of the body, a hot towel or a hot pack in which a gelatin ingredient is contained is brought into contact with the skin, so as to provide hyperthermic therapy. However, this method is wearisome and inefficacious.

Consequently, the utilization of an electric fan through the four seasons and usual exposure of far infrared rays beneficial to the human body have drawn considerable attention.

SUMMARY OF THE INVENTION

Accordingly, the present invention has been made in an effort to solve the problems occurring in the related art, and an object of the present invention is to provide an electric fan with a far infrared ray lamp serving as a hyperthermic therapy appliance, wherein the far infrared ray lamp for irradiating far infrared rays beneficial to the human body is fixedly disposed in front of a blower fan unit of the electric fan so as to independently or simultaneously utilize hyperthermic heat discharged from the far infrared ray lamp and air blown by the electric fan, thereby ensuring healthy drying of the body and hair, fomentation of an aching portion, and relief of fatigue due to stress.

In order to achieve the above object, according to one aspect of the present invention, there is provided an electric fan having control means for controlling entire operation of the electric fan, including a rotational velocity, an operation time and a wind direction, driving means for driving a blower fan unit in response to a driving signal outputted from the control means, and front and rear safety nets, characterized in that a far infrared ray lamp is attached to the front safety net, a lamp protective net coated with ceramic is placed at a front end of the far infrared ray lamp in such a way as to decrease a heat conductivity, the control means includes a hyperthermic heat timer, and a case and an outer wall, as a whole, of the electric fan are made of FRP-based synthetic resin which is heat-resistant, light and solid when compared to the conventional plastic material.

Further, in order to achieve the above object, according to another aspect of the present invention, there is provided an electric fan having a driving motor, a blower fan unit and a safety net, characterized in that a heat generation device comprising a far infrared ray lamp is located in front of the blower fan unit to enable hyperthermic heat discharged from the far infrared ray lamp and air blown by the electric fan to be independently or simultaneously utilized, and the electric fan includes control and display means for adjusting a wind direction, a wind speed, a rotational velocity, an operation time of the electric fan, a heat generation time of the far infrared ray lamp, etc.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
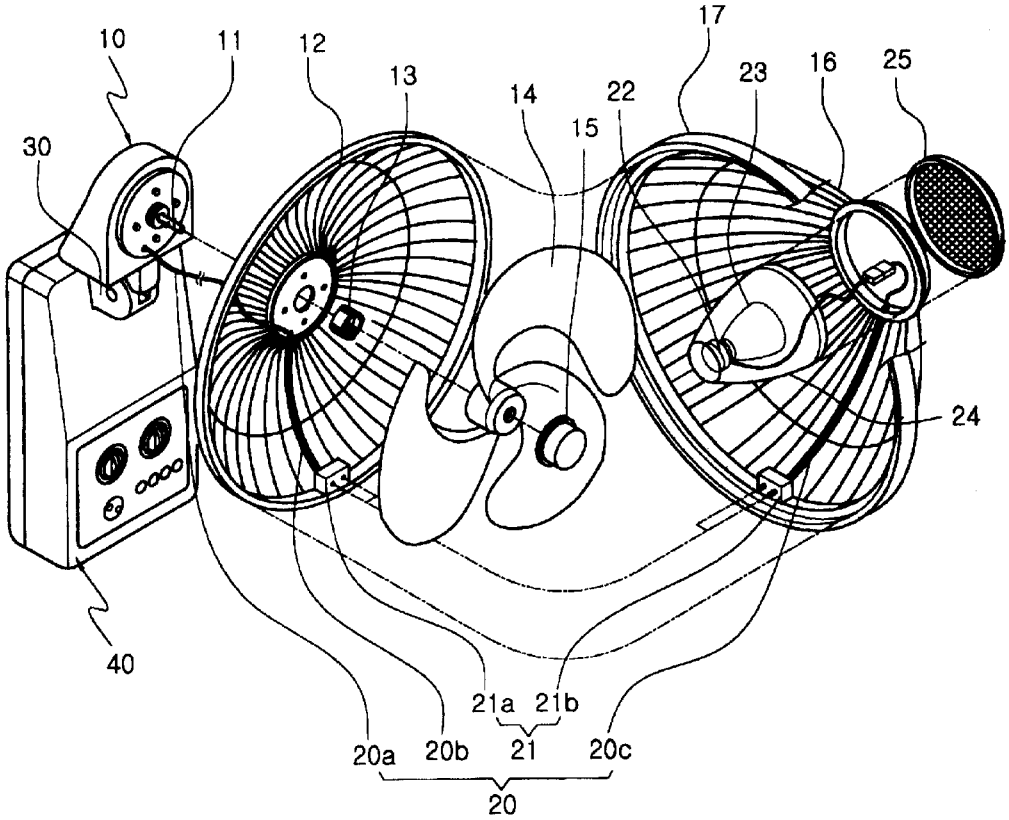
FIG. 1 is an exploded perspective view illustrating an electric fan with a far infrared ray lamp serving as a hyperthermic therapy appliance in accordance with a first embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

First, as shown in FIG. 1, an electric fan according to the present invention comprises an upper end section having a driving motor 10, a blower fan unit 14 and front and rear safety nets 16 and 12, a support bracket 30 and a control section 40.

According to the present invention, the electric fan is combined with a far infrared ray lamp so as to further serve as a hyperthermic therapy appliance. Therefore, an electric fan with a far infrared ray lamp serving as a hyperthermic therapy appliance in accordance with a first embodiment of the present invention will be described below.

Figure 2A:
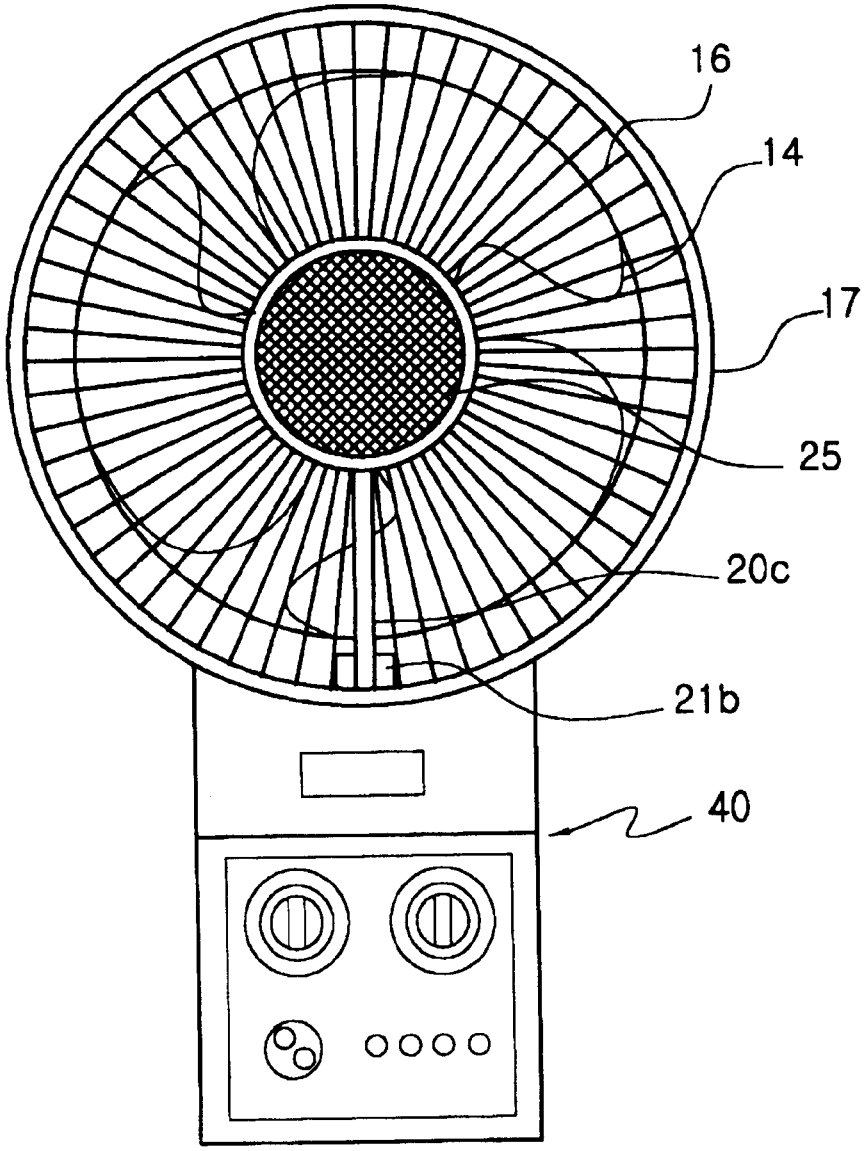
FIG. 2*a* is a front view of the electric fan with a far infrared ray lamp serving as a hyperthermic therapy appliance in accordance with the first embodiment of the present invention.
Figure 2B:
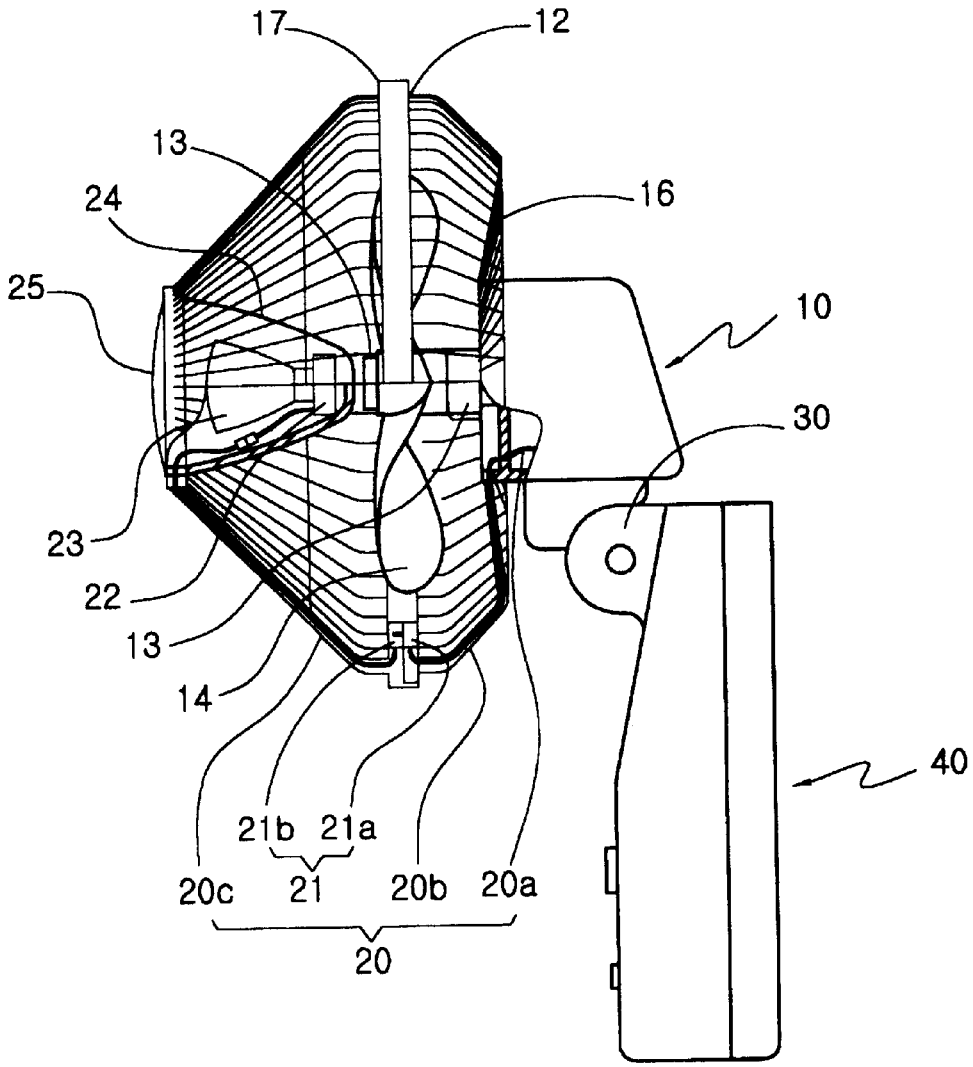
FIG. 2*b* is a partially broken-away side view of the electric fan with a far infrared ray lamp serving as a hyperthermic therapy appliance in accordance with the first embodiment of the present invention.

FIG. 1 is an exploded perspective view illustrating an electric fan with a far infrared ray lamp serving as a hyperthermic therapy appliance in accordance with a first embodiment of the present invention; FIG. 2*a* is a front view of the electric fan with a far infrared ray lamp serving as a hyperthermic therapy appliance in accordance with the first embodiment of the present invention; and FIG. 2*b* is a partially broken-away side view of the electric fan with a far infrared ray lamp serving as a hyperthermic therapy appliance in accordance with the first embodiment of the present invention. First, in the present invention, an AC power line is led from an upper part of the support bracket 30 and then connected to a far infrared ray lamp 23.

As shown in FIGS. 1 and 2, the front and rear safety nets 16 and 12 are made of stainless steel-based material which underwent a coating process on a surface thereof. The front and rear safety nets 16 and 12 are fastened to each other by a fastening ring 17 which is made of plastic material. Reference numeral 21 representatively designates a pair of connectors 21*a* and 21*b* which are joined to the fastening ring 17 so that power is supplied through the pair of connectors 21*a* and 21*b*.

As can be readily seen from FIGS. 1 and 2, a far infrared ray lamp power device 20, which is led from an upper part of the support bracket 30, passes through the rear safety net 12 which underwent the coating process on its surface. Then, after passing through the pair of connectors 21*a* and 21*b* which are joined to the fastening ring 17 for fastening the front and rear safety nets 16 and 12 to each other, the far infrared ray lamp power device 20 is connected to the front safety net 16. Concretely speaking, power is applied from a power line leading part 20*a* which is led from the upper part of the support bracket 30 to a first connection part 20*b* which is arranged on the rear safety net 12, from the first connection part 20*b* to the pair of connectors 21*a* and 21*b* which are joined to the fastening ring 17, and from the pair of connectors 21*a* and 21*b* to a second connection part 20*c* which is arranged on the front safety net 16. The far infrared ray lamp power device 20, which is connected to the front safety net 16 in this way, supplies power to the far infrared ray lamp 23 through a socket 22. At this time, the socket 22 is positioned in front of the blower fan unit 14. A far infrared ray lamp part which includes the socket 22 and the far infrared ray lamp 23 is accommodated in an insulating member 24 in such a way as to be surrounded thereby. As can be readily seen from FIG. 1, the insulating member 24 has a truncated hollow cone-shaped configuration. The far infrared ray lamp part is secured with respect to the front safety net 16 by the medium of the insulating member 24. Through another connection part which extends from the second connection part 20*c* to the inside of the insulating member 24, power is supplied to the socket 22.

It is preferred that the insulating member 24 is defined with a plurality of holes so as to prevent a temperature around the far infrared ray lamp 23 from rising.

As a consequence, when the blower fan unit 14 and the far infrared ray lamp 23 are independently or simultaneously operated, the blower fan unit 14 is not adversely influenced by heat generation of the far infrared ray lamp 23. Also, since the far infrared ray lamp 23 is independent of rotation of the blower fan unit 14, its reliable and safe heat generation is ensured.

The upper end section of the electric fan, which upper end section has the driving motor 10, has an outer wall made of Fiber reinforced plastic-based material which is heat-resistant. The blower fan unit 14 and the far infrared ray lamp 23 are disposed between the front and rear safety nets 16 and 12. At this time, a lamp protective net 25, which is resistant against heat of far infrared rays, is secured to the front safety net 16 in front of the far infrared ray lamp 23 serving as a heat generating part. Due to the fact that the lamp protective net 25 is structured so as to be easily attached to or detached from the front safety net 16, it is possible to conveniently replace the far infrared ray lamp 23 with new one.

The control section 40 serves as control and display means for adjusting a wind direction, a wind speed, a rotational velocity, an operation time of the electric fan, a heat generation time of the far infrared ray lamp 23, etc. and for enabling the blower fan unit 14 and the far infrared ray lamp part to be independently or simultaneously utilized.

Figure 3:
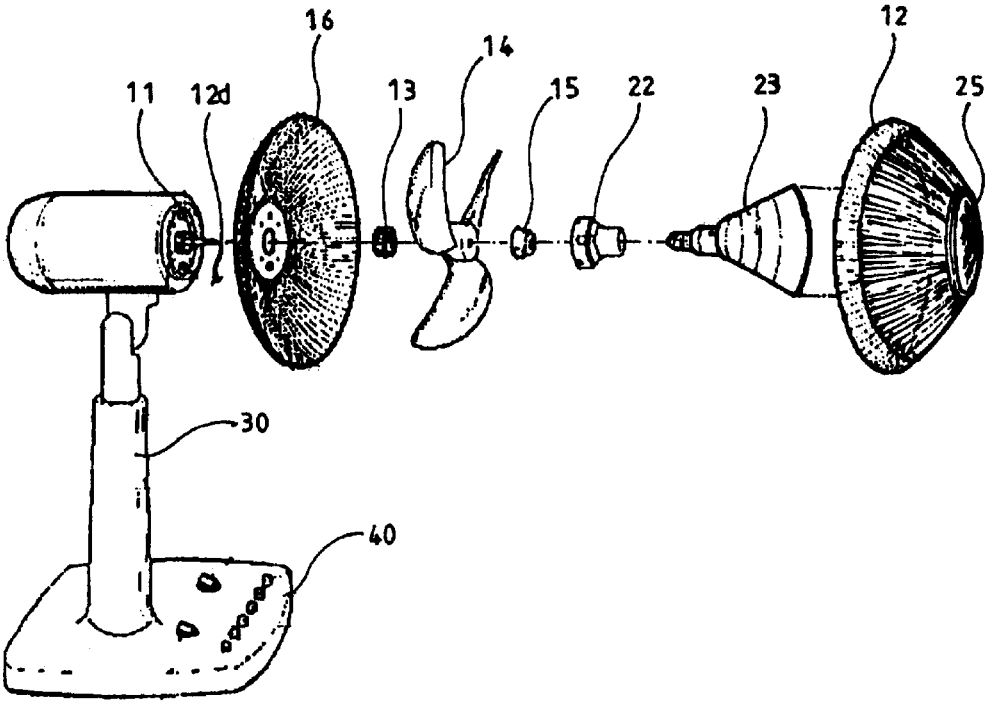
FIG. 3 is a schematic exploded perspective view illustrating an electric fan with a far infrared ray lamp serving as a hyperthermic therapy appliance in accordance with a second embodiment of the present invention.
Figure 4:
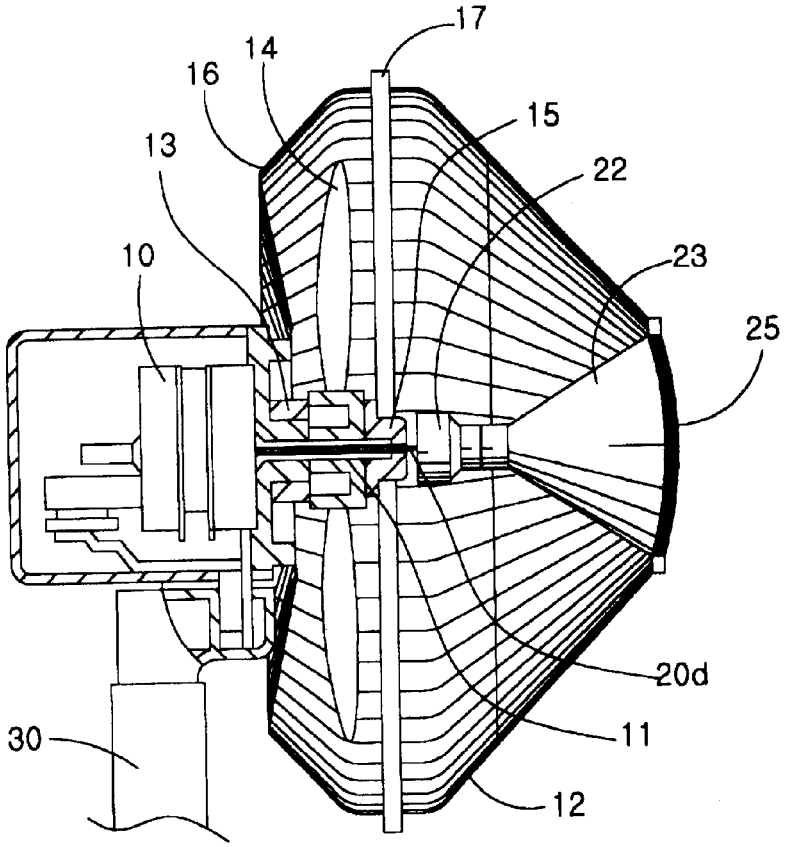
FIG. 4 is a side cross-sectional view of the electric fan with a far infrared ray lamp serving as a hyperthermic therapy appliance in accordance with the second embodiment of the present invention.

FIG. 3 is a schematic exploded perspective view illustrating an electric fan with a far infrared ray lamp serving as a hyperthermic therapy appliance in accordance with a second embodiment of the present invention; and FIG. 4 is a side cross-sectional view of the electric fan with a far infrared ray lamp serving as a hyperthermic therapy appliance in accordance with the second embodiment of the present invention. In the following descriptions, structural elements which are the same as those shown in FIGS. 1, 2*a* and 2*b* according to the first embodiment shall be designated by like reference numerals, and detailed discussion thereof shall be omitted.

As shown in FIGS. 3 and 4, an output shaft 11 of the driving motor 10 which is positioned at the upper part of the support bracket 30 is formed to have a pipe-shaped configuration so that a power line leading part 20*d* having the form of a cable and serving as the far infrared ray lamp power device 20 passes through the output shaft 11 to supply power to the far infrared ray lamp 23.

To the output shaft 11 structured in this way, the rear safety net 12 is coupled by a safety net fastener 13, and then, the blower fan unit 14 is fastened by the blower fan unit fastener 15.

The power line leading part 20*d* is connected to the socket 22 which is positioned in front of the blower fan unit fastener 15, whereby power can be supplied to the far infrared ray lamp 23 fitted into the socket 22.

The far infrared ray lamp 23 is installed at a front end thereof on the front safety net 16 and protected thereby. In other words, the front safety net 16 functions to fasten the far infrared ray lamp 23 and at the same time protect the far infrared ray lamp 23 and the blower fan unit 14. The lamp protective net 25 which is resistant against heat of far infrared rays is secured to the front safety net 16 in front of the far infrared ray lamp 23 serving as a heat generating part. While it is preferable for the lamp protective net 25 to be structured so as to be easily attached to or detached from the front safety net 16 so that it is possible to conveniently replace the far infrared ray lamp 23 with new one, the lamp protective net 25 can be integrally formed with the front safety net 16.

In the meanwhile, the safety net fastener 13, the blower fan unit 14, and the blower fan unit fastener 15 are respectively defined at center portions thereof with holes so that the power line leading part 20*d* can pass through the holes. Due to the fact that the blower fan unit 14 is fastened to the output shaft 11 of driving motor 10 by the blower fan unit fastener 15 which is threaded around a circumferential outer surface of the output shaft 11, the blower fan unit 14 is integrally rotated with the output shaft 11. Since the power line leading part 20*d* serving as the far infrared ray lamp power device 20 extends through the output shaft 11 of the driving motor 10, it is possible to supply power to the socket 22 fastened with respect to the front safety net 16, irrespective of the rotating motion of the blower fan unit 14. In this way, rotation of the blower fan unit 14 and heat generation of the far infrared ray lamp 23 are not adversely influenced by each other.

While the present invention was described with respect to a wall type electric fan in the first embodiment and a stand type electric fan in the second embodiment, it is to be readily understood that the present invention is not limited to these types of electric fans and may be applied to a variety of types of electric fans without departing from the scope and spirit of the present invention.

As apparent from the above descriptions, the electric fan with a far infrared ray lamp serving as a hyperthermic therapy appliance, according to the present invention, provides advantages in that, since a far infrared ray lamp part is positioned in front of a blower fan unit, it is possible to independently or simultaneously utilize hyperthermic heat discharged from the far infrared ray lamp and air blown by the electric fan.

Also, in the present invention, it is not necessary for the general public to employ a separate instrument or facility so as to individually experience efficacy of far infrared rays. Instead, it is possible to usually experience efficacy of far infrared rays, for example, upon drying the body or hair after taking a shower or bath. That is to say, a person can feel, in a short period of time, penetration of directly and momentarily irradiated far infrared rays into the skin, whereby it is possible to save electricity rates in comparison with the conventional fomenting instrument or drier.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An electric fan including a driving motor, a blower fan unit, and front and rear safety nets, characterized in that a far infrared ray lamp part including a socket and a far infrared ray lamp is positioned in front of the blower fan unit, the front and rear safety nets are detachably fastened to each other by a fastening ring, and a lamp protective net, which is covered with a stainless coating to be decreased in heat conductivity and heat-resistant, is placed in front of the far infrared ray lamp part where heat is generated.

2. The electric fan as claimed in claim 1, wherein the far infrared ray lamp part is secured to the front safety net by the medium of an insulating member which is contoured in such a way as to surround the far infrared ray lamp part, and power is supplied to the far infrared ray lamp part via a far infrared ray lamp power device which is led from a support bracket of the electric fan.

3. The electric fan as claimed in claim 2, wherein, in the far infrared ray lamp power device, power is applied from a power line leading part which is led from an upper part of the support bracket to a first connection part which is arranged on the rear safety net, from the first connection part to a pair of connectors which are joined to the fastening ring, from the pair of connectors to a second connection part which is arranged on the front safety net, and then, from the second connection part to the socket of the far infrared ray lamp part through the insulating member, whereby the far infrared ray lamp part can be turned on by the power.

4. The electric fan as claimed in claim 1, wherein an output shaft of the driving motor is formed to have a pipe-shaped configuration so that a cable of the far infrared ray lamp power device passes through the output shaft, and a safety net fastener, the blower fan unit, and a blower fan unit fastener are respectively defined with holes so that the cable led from the output shaft of the driving motor is connected with the socket after passing through the holes.

5. The electric fan as claimed in claim 1, wherein the electric fan further includes a control section serving as control means of a main power device, for A adjusting a wind direction, a wind speed, a rotational velocity, an operation time of the electric fan, a heat generation time of the far infrared ray lamp, and for enabling the blower fan unit and the far infrared ray lamp part to be independently or simultaneously utilized; and an outer wall, as a whole, of fiber reinforced plastic the electric fan is made based material which is heat-resistant, light and solid.

* * * * *